US012687298B1

(12) United States Patent
Binek et al.

(10) Patent No.: US 12,687,298 B1
(45) Date of Patent: Jul. 21, 2026

(54) COMBUSTOR CASE ARRANGEMENT

(71) Applicant: RTX Corporation, Farmington, CT (US)

(72) Inventors: Lawrence Binek, Glastonbury, CT (US); Frederick Rosenberger, Marlborough, CT (US); Jaime Antonio Arbona, Winter Garden, FL (US); Timothy Snyder, Glastonbury, CT (US)

(73) Assignee: RTX Corporation, Farmington, CT (US)

( * ) Notice: Subject to any disclaimer, the term of this patent is extended or adjusted under 35 U.S.C. 154(b) by 0 days.

(21) Appl. No.: 19/290,067

(22) Filed: Aug. 4, 2025

(51) Int. Cl.

| | |
|---|---|
| ***F23R 3/00*** | (2006.01) |
| ***F23R 3/04*** | (2006.01) |
| ***F23R 3/28*** | (2006.01) |
| ***F23R 3/60*** | (2006.01) |

(52) U.S. Cl.
CPC ..... *F23R 3/002* (2013.01); *F23R 3/04* (2013.01); *F23R 3/28* (2013.01); *F23R 3/60* (2013.01)

(58) Field of Classification Search
CPC .... F23R 3/60; F23R 3/002; F23R 3/04; F23R 3/045; F23R 3/06
See application file for complete search history.

(56) References Cited

U.S. PATENT DOCUMENTS

| | | | | |
|---|---|---|---|---|
| 3,581,492 | A * | 6/1971 | Norgren | F23R 3/06 431/352 |
| 3,974,646 | A | 8/1976 | Markowski et al. | |
| 5,687,572 | A * | 11/1997 | Schrantz | F23R 3/06 60/753 |
| 5,749,219 | A | 5/1998 | Dubell | |
| 9,068,748 | B2 | 6/2015 | Hoke | |
| 10,895,383 | B2 | 1/2021 | Pascaud et al. | |
| 12,270,543 | B2 | 4/2025 | Binek et al. | |
| 2004/0118127 | A1 * | 6/2004 | Mitchell | F23R 3/007 60/752 |

FOREIGN PATENT DOCUMENTS

| | | | | |
|---|---|---|---|---|
| CA | 2494251 C | * | 6/2007 | F23R 3/286 |
| GB | 744593 A | * | 2/1956 | F23R 3/045 |
| GB | 798865 A | * | 7/1958 | F23R 3/04 |
| KR | 101902113 B1 | * | 9/2018 | F23R 3/42 |

* cited by examiner

*Primary Examiner* — Andrew H Nguyen
(74) *Attorney, Agent, or Firm* — Kinney & Lange, P.A.

(57) ABSTRACT

A combustor assembly for a gas turbine engine includes a combustor liner disposed about an axis and defining a combustion chamber and an outer case disposed about the combustor liner and defining an air flow duct therebetween. The combustor liner includes an outer wall having a plurality of mounting bosses and a plurality of first holes open to the combustion chamber. The outer case includes a plurality of inlet scoops extending radially inward of the outer case and radially aligned with the plurality of first holes to guide an air flow into first holes. A plurality of pins is fixed to the outer case and slidingly received in openings in the plurality of mounting bosses.

14 Claims, 4 Drawing Sheets

COMBUSTOR CASE ARRANGEMENT

BACKGROUND

The present disclosure relates generally to gas turbine engines and more particularly to combustor assemblies of gas turbine engines.

Gas turbine engines are continuous combustion engines that can be used for various purposes, such as power generation and/or producing thrust in an aircraft. Gas turbine engines include one or more compressor sections, one or more combustor sections, and one or more turbine sections. The compressor section receives and compresses air to increase the pressure of the air before the air reaches the combustor section. The combustor section receives the high-pressure air, mixes the high-pressure air with a fuel, and ignites the fuel and air mixture to produce exhaust gases. The exhaust gases flow from the combustor section to the turbine section where energy is extracted from the exhaust gases for use by the gas turbine engine. The combustor section of the gas turbine engine can include an outer case, a combustion liner, and a fuel delivery system. The outer case defines a duct for the high-pressure air received from the compressor section. The combustor liner is disposed within the outer case and defines a combustion chamber. The combustor liner includes openings for receiving the high-pressure air. The fuel delivery system delivers fuel to the combustion chamber.

In some embodiments, the high-pressure air can be directed into a primary zone of the combustion chamber via chutes projecting into the combustion chamber. Obtaining as much flow as possible can improve combustion performance. A need exists for a combustor arrangement that can direct an appreciable amount of high-pressure air from the compressor section to the primary zone of the combustion chamber and enable assembly of the combustor liner within the outer case in a manner that accommodates thermal growth of the combustor liner during operation.

SUMMARY

A combustor assembly for a gas turbine engine includes a combustor liner disposed about an axis and defining a combustion chamber and an outer case disposed about the combustor liner and defining an air flow duct therebetween. The combustor liner includes an outer wall having a plurality of mounting bosses and a plurality of first holes open to the combustion chamber. The outer case includes a plurality of inlet scoops extending radially inward of the outer case and radially aligned with the plurality of first holes to guide an air flow into first holes. A plurality of pins is fixed to the outer case and slidingly received in openings in the plurality of mounting bosses.

A combustor assembly for a gas turbine engine includes a combustor liner disposed about an axis and defining a combustion chamber and an outer case disposed about the combustor liner and defining an air flow duct therebetween. The combustor liner includes an outer wall having a plurality of mounting bosses, a plurality of holes open to the combustion chamber, and a plurality of flow guides extending radially outward from the outer wall partially around the plurality of holes. The outer case includes a plurality of inlet scoops connected to and extending radially inward of the outer case the plurality of holes. The plurality of inlet scoops extend axially from an open first end to a closed second end opposite the first end. The plurality of inlet scoops include walls that converge in extension from the first end to the second end. A plurality of pins is fixed to the outer case and slidingly received in openings in the plurality of mounting bosses.

The present summary is provided only by way of example, and not limitation. Other aspects of the present disclosure will be appreciated in view of the entirety of the present disclosure, including the entire text, claims and accompanying figures.

Figure 1:
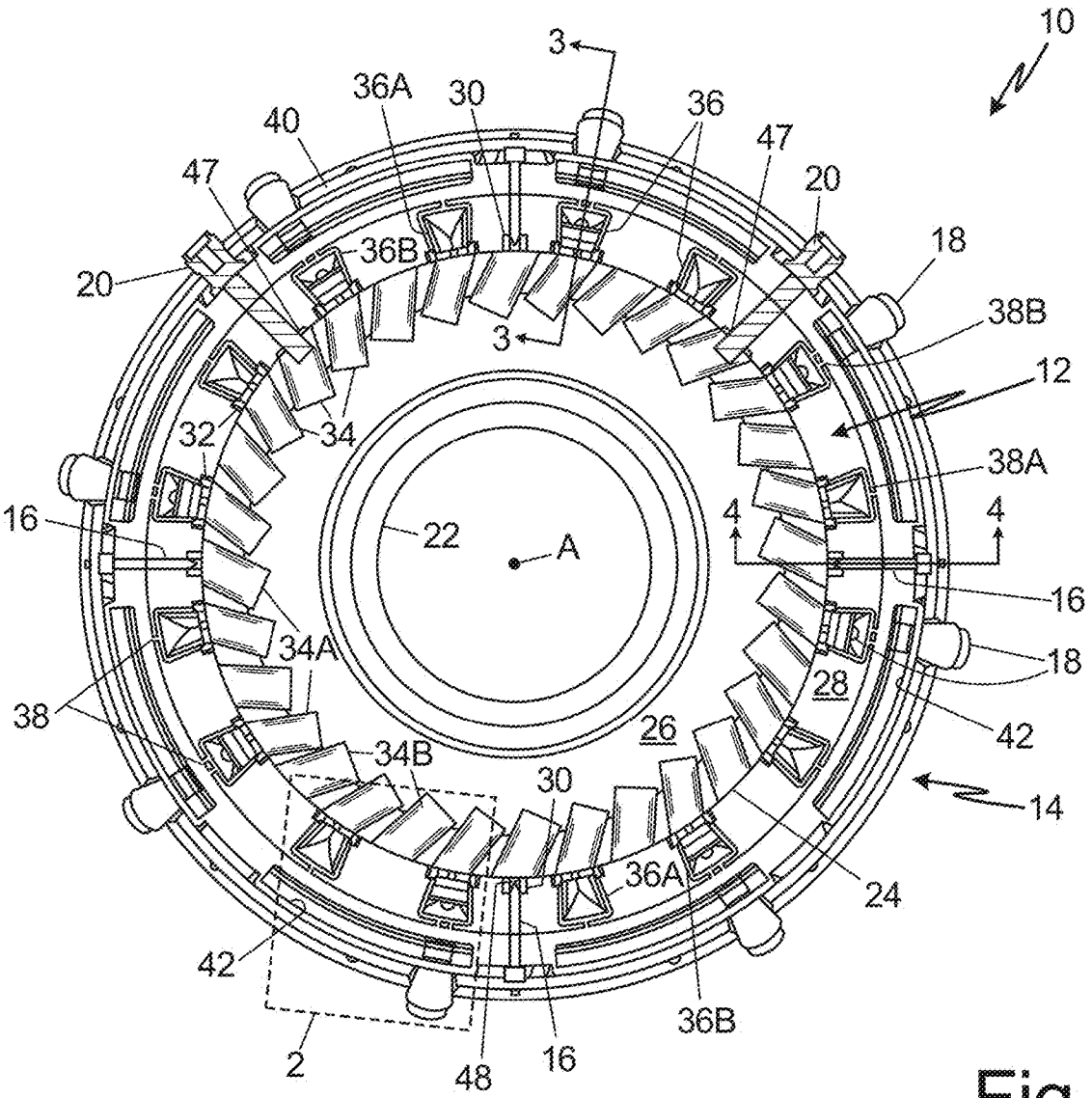
FIG. 1 is aft-facing sectional view of a combustor assembly for a gas turbine engine.

While the above-identified figures set forth embodiments of the present invention, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features, steps and/or components not specifically shown in the drawings.

DETAILED DESCRIPTION

The disclosed combustor assembly includes a combustor outer case, combustion liner, attachment features, and an integral fuel delivery system. The combustor outer case includes a series of inlet scoops which divert flow from a compressor outlet to a primary zone of a combustion chamber with a subset of inlet scoops used for fuel delivery. The combustion liner is positioned using radial pins. The disclosed configuration supports combustor performance by directing an appreciable amount of high-pressure air flow from the compressor outlet into the primary zone of the combustion chamber while accommodating thermal growth of the combustor liner during operation.

FIG. 1 is aft-facing sectional view of combustor assembly 10. FIG. 1 shows combustor assembly 10, combustor liner 12, outer case 14, locating pins 16, fuel injectors 18, ignitors 20, and axis A. Combustor liner 12 includes radially inner wall 22 and radially outer wall 24 defining combustion chamber 26 therebetween. Outer case 14 and outer wall 24 of combustor liner 12 define duct 28 configured to deliver high-pressure air from a compressor section of the gas turbine engine to the combustion chamber 26. Outer wall 24 can include mounting bosses 30, flow guides 32, and chutes 34. Outer case 14 can include inlet scoops 36, struts 38, fuel manifold 40, and bypass ducts 42.

Combustor assembly 10 is disposed about axis A, which can be an engine axis of the gas turbine engine. FIG. 1 is an aft-facing view of combustor assembly 10 with respect to a direction of fluid flow. Combustor assembly 10 is disposed to receive high-pressure air from an upstream compressor section of the gas turbine engine and to deliver combustion gases to a downstream turbine section of the gas turbine engine.

Combustor liner 12 is an annular combustor liner having inner wall 22 and outer wall 24. Inner wall 22 defines an inner diameter of combustor liner 12. Outer wall 24 defines an outer diameter of combustor liner 12. Inner wall 22 and outer wall 24 define combustion chamber 26 therebetween. Combustor liner 12 can extend axially from a domed forward end (not shown), connecting inner wall 22 and outer wall 24, to an open aft end in fluid communication with the turbine section. As used herein, the terms "forward," "upstream," "aft," and "downstream" refer to a direction of fluid flow F (shown in FIG. 3) through outer case 14 and about combustor liner 12. As described further herein, combustor liner 12 and features thereof can be integrally formed via additive manufacturing and assembled with outer case 14.

Outer case 14 is disposed concentrically about combustor liner 12. Outer case 14 and outer wall 24 of combustor liner 12 define duct 28 therebetween. Duct 28 is open at an upstream end and disposed to receive high-pressure air from the compressor section (i.e., from a diffuser outlet of the compressor section). As discussed further herein, outer case 14 and features thereof can be integrally formed via additive manufacturing.

A plurality of radially-extending locating pins 16 are disposed circumferentially about combustor assembly 10. Locating pins 16 are assembled with combustor liner 12 and outer case 14 and configured to couple combustor liner 12 with outer case 14. As described further herein, locating pins 16 are configured to locate combustor liner 12 within outer case 14 and retain a position of combustor liner 12 within outer case 14 while accommodating thermal growth of combustor liner 12 during operation of the gas turbine engine.

A plurality of fuel injectors 18 are disposed circumferentially about combustor assembly 10. Fuel injectors 18 are assembled with combustor liner 12 and outer case 14 and are configured to deliver fuel from fuel manifold 40 to combustion chamber 26.

A plurality of ignitors 20 can be assembled with combustor liner 12 and outer case 14. Ignitors 20 are configured to ignite the fuel and air mixture in combustion chamber 26.

Combustor liner 12 is configured to transmit high-pressure air from duct 28 and fuel from fuel injectors 18 to combustion chamber 26. Outer wall 24 includes a plurality of holes 44 (shown in FIG. 2) therethrough to permit fluid flow into combustion chamber 26. Chutes 34 can define hole outlets and direct the high-pressure air into combustion chamber 26. Chutes 34 project from a radially inner surface of outer wall 24 into combustion chamber 26. Chutes 34 can be angled circumferentially as shown in FIG. 1 to provide rotational flow or swirl of the high-pressure air and fuel as it enters combustion chamber 26 to promote mixing and complete combustion. Holes 44 and chutes 34 can be provided in a plurality of circumferentially extending rows. For example, chutes 34 can include chutes 34A provided in a first row and chutes 34B provided in a second row disposed axially downstream of chutes 34A. As described further herein, chutes 34A can be disposed to deliver high-pressure air and fuel to a primary combustion zone of combustion chamber 26 adjacent to a forward end of combustor liner 12. Chutes 34B can be configured to deliver high-pressure air to a downstream secondary combustion zone of combustion chamber 26. Chutes 34 can have any shape or orientation and can be provided in any arrangement suitable for delivering high-pressure air and fuel to combustion chamber 26 to promote efficient and complete combustion.

In addition to chutes 34, combustor liner 12 can include a plurality of dilution holes (not shown), configured to deliver the high-pressure air to a dilution zone of combustion chamber 26, and a plurality of cooling holes 46 (shown in FIGS. 2 and 3), configured to provide film cooling of the surfaces of combustor liner 12 exposed to combustion gases (i.e., defining combustion chamber 26). Dilution holes and cooling holes 46 can be provided through each of inner wall 22 and outer wall 24 of combustor liner 12, as known in the art.

Additionally outer wall 24 of combustor liner can include holes 47 configured to receive ignitors 20. Holes 47 can be configured to slidingly receive ignitors 20 to accommodate thermal growth of combustor liner 12 during operation of the gas turbine engine. Ignitors 20 can be fixedly mounted to outer case 14. Holes 47 are open to the primary combustion zone where the high-pressure air and fuel are mixed. Holes 47 are not associated with chutes 34. The number and location of ignitors 20 is not limited to that shown. It will be understood by one of ordinary skill in the art that the number and location of ignitors 20 can be selected to provide successful ignition.

Outer wall 24 of combustor liner 12 can include a plurality of flow guides 32 to guide fluid flow into holes 44 and chutes 34. As described further herein, flow guides 32 extend radially outward from outer wall 24 into duct 28 and toward outer case 14. Flow guides 32 can extend partially around holes 44 to permit entry of high-pressure air into holes 44 and to block high-pressure air at an aft or downstream edge of holes 44. For example, flow guides 32 can have a C-like shape, with an opening at an upstream end to permit high-pressure air flow into holes 44 and walls around sides and a downstream end of holes 44. As described further herein, flow guides 32 can be limited to use with chutes 34A and inlet scoops 36 configured to direct high-pressure air and fuel to the primary combustion zone of combustion chamber 26.

Outer wall 24 can include a plurality of mounting bosses 30 configured to receive locating pins 16. Mounting bosses 30 are disposed circumferentially about outer wall 24 and extend radially outward therefrom toward outer case 14. Each mounting boss includes retention hole 48 configured to slidingly receive an end of locating pin 16. At least three mounting bosses 30 are disposed about outer wall 24 to locate and retain the radial, axial, and circumferential position of inner combustor liner 12 within outer case 14. Preferably, mounting bosses 30 are uniformly distributed about outer wall 24 of combustor liner 12. As illustrated in FIG. 1, four mounting bosses 30 can be disposed about outer wall 24 at 90-degree increments about axis A such that pairs of mounting bosses 30 are disposed 180 degrees from one another about axis A (i.e., within the same radial plane). In other embodiments, more than four mounting bosses 30 can be included to provide additional support of combustor liner 12. Because locating pins 16 extend radially through duct 28, the number of locating pins 16 used to locate and retain combustor liner 12 within outer case 14 is preferably limited to those required for structural support to minimize blockage of fluid flow by locating pins 16. As further described herein, locating pins 16 are fixed to outer case 14 and free to move radially within retention holes 48 to accommodate thermal growth of combustor liner 12 during operation of the gas turbine engine.

Combustor liner 12, including mounting bosses 30, flow guides 32, and chutes 34, can be formed as a unitary body via additive manufacturing. For example, combustor liner 12 can be formed via a powder bed fusion additive manufacturing process, such as laser powder bed fusion or electron beam powder bed manufacturing methods. Combustor liner 12 can be built along axis A, for example, in the forward to aft direction.

Outer case 14 includes a plurality of inlet scoops 36 configured to capture and guide a desired amount of high-pressure air received from the compressor section into combustion chamber 26. A first subset of inlets scoops 36 is identified as inlet scoops 36A. A second subset of inlet scoops 36 is identified as inlet scoops 36B. Inlet scoops 36A are configured to deliver high-pressure air to combustion chamber 26. Inlet scoops 36B are configured to deliver high-pressure air and fuel to combustion chamber 26, as described further herein. Inlet scoops 36 are spaced circumferentially about a radially inner surface of outer case 14 and about outer wall 12 of combustor liner 12. Inlet scoops 36 can be uniformly distributed about outer wall 24. Inlet scoops 36 are radially aligned with chutes 34A to direct the high-pressure air and fuel to the primary combustion zone of combustion chamber 26. Inlet scoops 36 are open at an upstream end and closed at a downstream end to guide the high-pressure air into holes 44 and chutes 34A.

As discussed further herein, inlet scoops 36 can include a plurality of walls, which can be oriented to increase a velocity of the high-pressure air entering combustion chamber 26. Fuel injectors 18 are received in inlet scoops 36B. As described further herein, inlet scoops 36B can include a splash plate configured to help atomize fuel received from fuel injectors 18 before entering chutes 34A with high-pressure air.

Inlet scoops 36 are connected to outer case 14 via struts 38. Struts 38 extend radially from a radially outer wall of inlet scoops 36 to the radially inner wall of outer case 14, thereby radially spacing inlet scoops 36 from the radially inner surface of outer case 14. A height of a gap between each inlet scoop 36 and the radially inner surface of outer case 14 can be defined by a height of the respective strut 38. As discussed further herein, a height of the gap can vary in the axial direction. Specifically, the height of the gap can increase from an upstream end of inlet scoop 36 to the downstream end of inlet scoop 36. A first subset of struts 38 is identified as struts 38A. A second subset of struts 38 is identified as struts 38B. Struts 38A are associated with inlet scoops 36A. Struts 38B are associated with inlet scoops 36B. In some embodiments, struts 38A and 38B can have differing thicknesses and/or shapes. For example, struts 38B can be designed to support inlet scoops 36B while also accommodating fuel injectors 18. Generally, struts 38 can be configured to provide structural support for inlet scoops 36 while minimizing or limiting blockage of high-pressure air through duct 28 and/or promoting efficient fluid flow through the gap between inlet scoops 36 and the radially inner surface of outer case 14.

Outer case 14 can include a plurality of holes and/or mounting features configured for fixedly mounting locating pins 16, fuel injectors 18, and ignitors 20 as described further herein.

Outer case 14, including inlet scoops 36, struts 38, and mounting features, can be formed as unitary body via additive manufacturing. For example, outer case 14 can be formed via a powder bed fusion additive manufacturing process, such as laser powder bed fusion or electron beam powder bed manufacturing methods. Outer case 14 can be built along axis A, for example, in the forward to aft direction.

Figure 2:
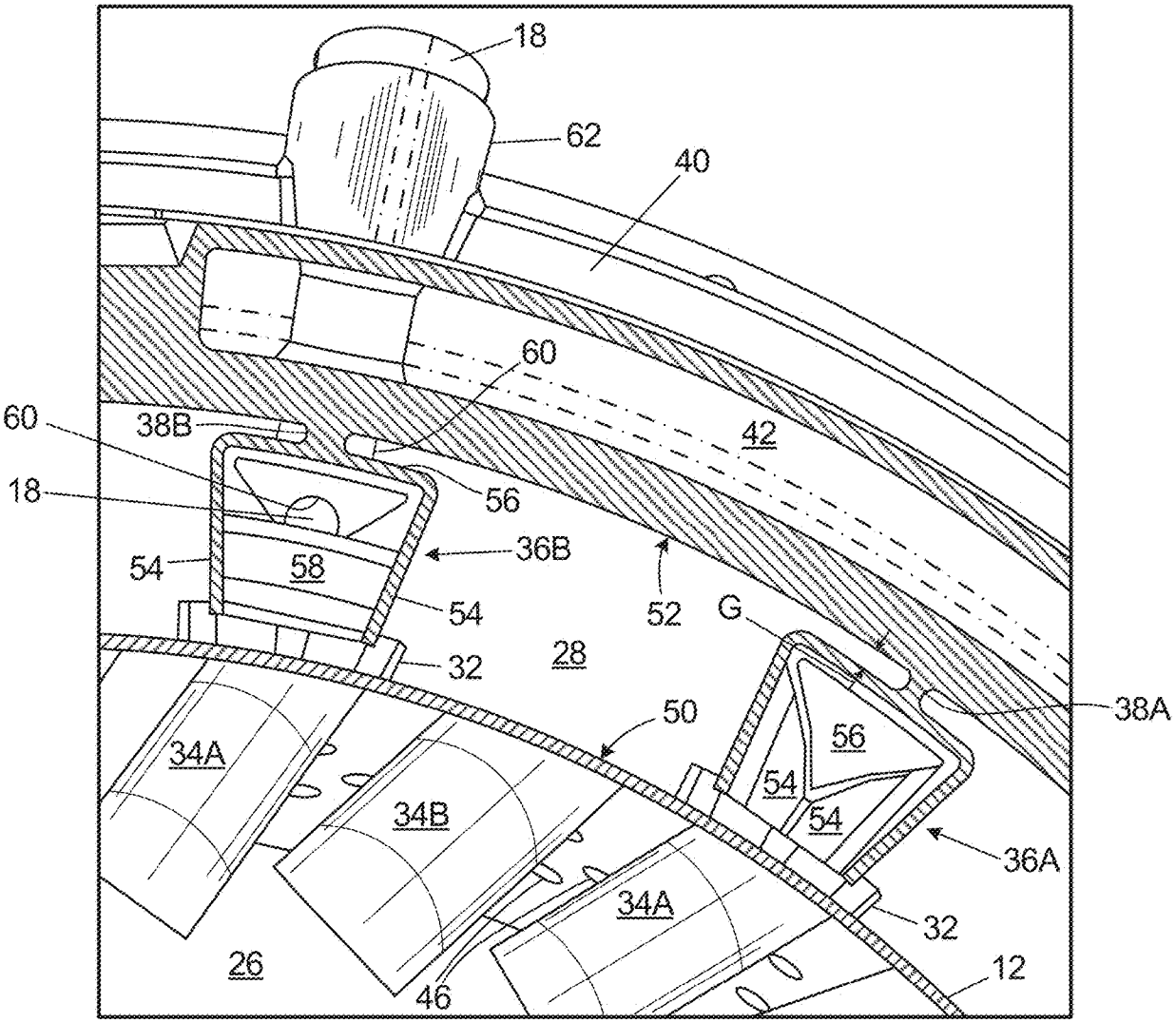
FIG. 2 is an enlarged view of portion 2 of FIG. 1.

FIG. 2 is an enlarged view of portion 2 of FIG. 1. FIG. 2 is rotated 180 degrees for clarity. FIG. 2 shows combustor liner 12 and outer case 14. Combustor liner 12 includes outer wall 24, flow guides 32, chutes 34A and 34B, cooling holes 46, and radially outer surface 50, while outer case 14 includes inlet scoops 36A and 36B, struts 38A and 38B, fuel injector 18, fuel manifold 40, bypass duct 42, radially inner surface 52, side walls 54, outermost wall 56, splash plate 58, opening 60, and mounting element 62.

Combustor liner 12 is disposed within outer case 14 such that inlet scoops 36 align radially with holes 44 opening to chutes 34A. Specifically, a radially inner opening of inlet scoops 36 aligns radially with holes 44 to direct high-pressure air and fuel into combustion chamber 26 via holes 44 and chutes 34A. As described further herein, a portion of each inlet scoop 36 is received in a respective flow guide 32 such that the flow guides 32 and portions of the inlet scoops 36 overlap radially, while maintaining a gap between each inlet scoop 36 and outer wall 24 of combustor liner 12 to accommodate thermal growth of combustor liner 12 without binding.

Flow guides 32 extend radially outward from radially outer surface 50 of outer wall 24. Flow guides 32 have a height measured from outer wall 24 selected to provide radial overlap with inlet scoops 36 to block high-pressure air flowing between each of inlet scoops 36 and outer wall 24 from bypassing holes 44 and chutes 34A and promote flow of the high-pressure air into holes 44 and chutes 34A. Flow guides 32 are open at an upstream end to receive the high-pressure air flow along outer wall 24.

Inlet scoops 36A and 36B are suspended from radially inner surface 52 of outer case 14 by struts 38A and 38B, respectively. Inlet scoops 36A and 36B can be substantially similar having side walls 54 and outermost wall 56. Inlet scoop 36B additionally includes splash plate 58 and opening 60. Inlet scoops 36A and 36B are generally referred to collectively herein as inlet scoops 36. Where they differ, inlet scoops 36A and 36B are discussed separately.

Together, side walls 54 and outermost wall 56 define a flow guide structure that opens at an upstream end to receive high-pressure air from the compressor section outlet and opens at a radially inner end to direct the high-pressure air into combustion chamber 26 via holes 44 and chutes 34A. Outermost walls 56 are disposed adjacent to radially inner surface 52 of outer case 14 and spaced apart therefrom by struts 38. A gap G defined between each of outermost wall 56 and outer case 14 can have a height selected to promote a desired flow of high-pressure air radially outward of inlet scoops 36 such that inlet scoops 36 do not fully block fluid flow over the radial extent of duct 28. Side walls 54 extend radially inward from circumferentially opposite sides of outermost wall 56. Side walls 54 extend toward outer wall 24 of combustor liner 12 and are spaced therefrom to accommodate radially outward movement of combustor liner 12 with thermal growth. Side walls 54 and outermost wall 56 are oriented to increase a velocity of the high-pressure air entering combustion chamber 26. For example, opposing side walls 54 can be angled inward from outermost wall 56 toward outer wall 24 of combustor liner 12 to reduce a cross-sectional area of inlet scoops 36 from a radially outer extent adjacent outermost wall 56 to a radially inner extent adjacent to outer wall 24 of combustor liner 12. Side walls 54 can converge in an axial direction from the upstream end to the downstream end of inlet scoops 36. As best illustrated in inlet scoop 36A, side walls 54 can meet at the downstream end. Outermost wall 56 extends axially from the upstream end of inlet scoops 36 toward the downstream end. Outermost wall 56 can slope radially inward toward the downstream end. Outermost wall 56 can converge with side walls 54 at the downstream end to close the downstream end of inlet scoops 36. The orientation of side walls 54 and outermost wall 56 can reduce an interior volume of each inlet scoop 36 from the upstream end to the downstream end and thereby increase a velocity of the high-pressure air entering holes 44 and thereby combustion chamber 26.

The shape of inlet scoops 36 is not limited to the embodiment described herein. Generally, inlet scoops 36 can be configured to surround holes 44 on three sides with an opening at the upstream end to receive high-pressure air from the compressor section (e.g., a diffuser outlet) disposed axially forward of inlet scoops 36. Inlet scoops 36 can have walls that converge in a forward to aft direction and/or in a radial direction to increase a velocity of the high-pressure air entering combustion chamber 26. Walls of inlet scoops 36 can further be configured to minimize or limit disruption of or promote efficient fluid flow downstream of inlet scoops 36. A quantity of inlet scoops 36 can be selected to provide a desired volume of high-pressure air to the primary combustion zone of combustion chamber 26.

Figure 3:
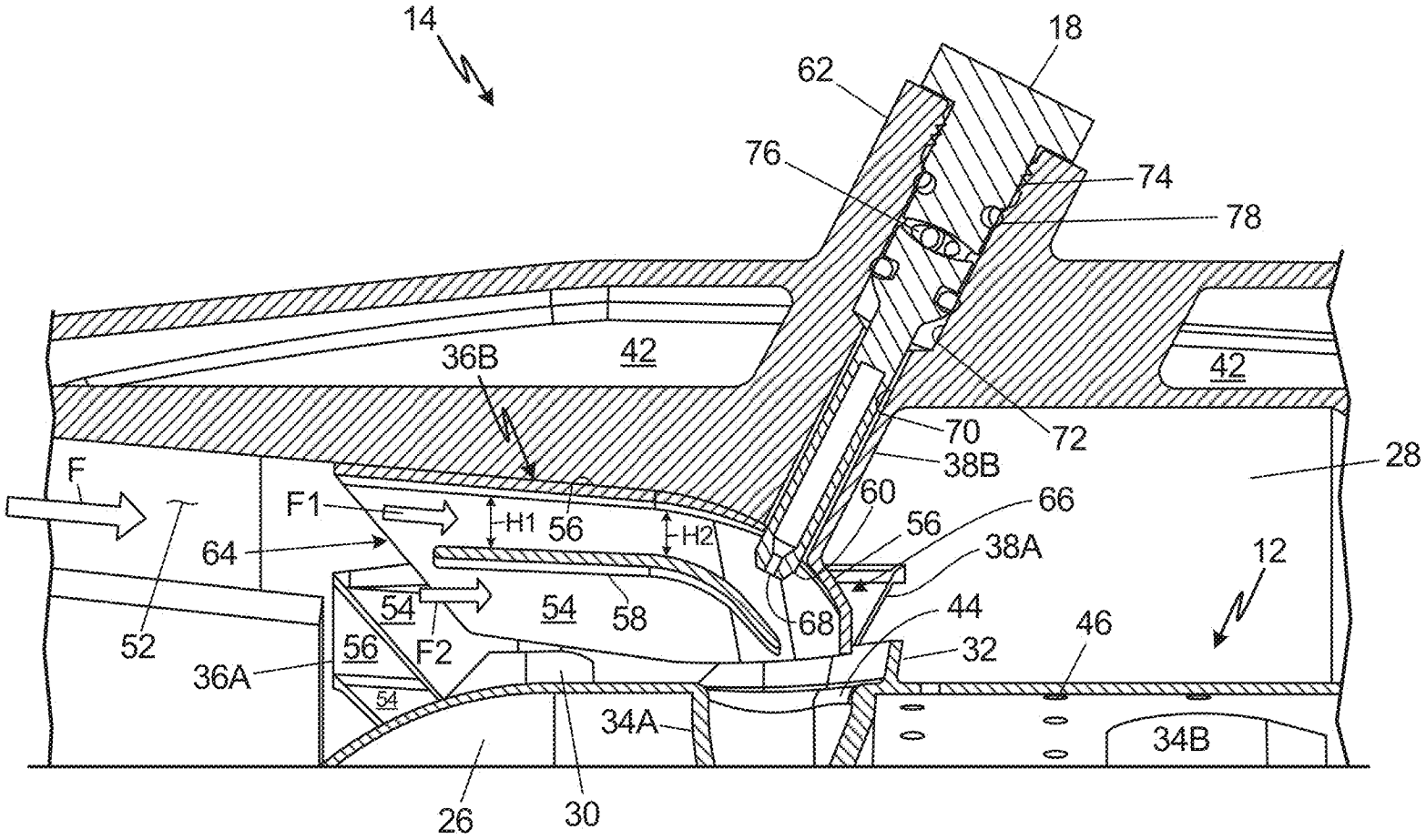
FIG. 3 is a cross-sectional view of the combustor assembly taken along the 3-3 line of FIG. 1.

Inlet scoops 36B are configured to deliver high-pressure air and fuel to combustion chamber 26. Each inlet scoop 36B can include splash plate 58 and opening 60. Splash plate 58 is configured to help atomize fuel received from fuel injectors 18 before entering chutes 34A with high-pressure air. Splash plate 58 is disposed in inlet scoop 36B and connects side walls 54. Splash plate 58 extends in a generally axial direction from a location adjacent to the upstream end of inlet scoop 36 toward a radially inner opening of inlet scoop 36B as best shown in FIG. 3 and discussed further herein. Splash plate 58 is spaced apart from outermost wall 56. Generally, splash plate 58 can be configured to divide the flow of high-pressure air entering inlet scoop 36B into a radially outer flow path and a radially inner flow path.

Opening 60 is configured to receive fuel injector 18. As further described herein, a nozzle outlet of fuel injector 18 can be disposed in the outer radial flow path formed by splash plate 58 and can face splash plate 58 to eject fuel toward splash plate 58.

Struts 38 are configured to support inlet scoops 36. Struts 38 extend axially and connect outermost walls 56 to radially inner surface 52 of outer case 14. Generally, struts 38 can be configured to provide structural support for inlet scoops 36 while minimizing or limiting blockage of high-pressure air through duct 28 and/or promoting efficient fluid flow through the gap between inlet scoops 36 and radially inner surface 52 of outer case 14. As illustrated in FIG. 2, struts 38 can be centrally located along outermost wall 56 of inlet scoops 36 and can have a thickness measured in a circumferential direction that is significantly less than a circumferential width of inlet scoops 36. In some embodiments, struts 38A and 38B can differ in structure. For example, in some embodiments, struts 38B can have a thickened region to accommodate fuel injectors 18 extending therethrough.

Fuel manifold 40 can be an annular manifold formed in outer case 14 and radially and circumferentially aligned with inlets of fuel injectors 18. As described further herein, fuel injectors 18 can be modular injectors configured for assembly with combustor assembly 10. Outer case 14 can include a plurality of mounting elements 62 for mounting fuel injectors 18.

FIG. 3 is a cross-sectional view of combustor assembly 10 taken along the 3-3 line of FIG. 1. FIG. 3 shows combustor liner 12, including outer wall 24, combustion chamber 26, mounting boss 30, hole 44, flow guide 32, chutes 34A and 34B, and cooling holes 46; outer case 14, including inlet scoops 36A and 36B with side walls 54, outermost wall 56, upstream end 64, and downstream end 66, splash plate 58 of inlet scoop 36B defining outer radial flow path F1, and inner radial flow path F2, struts 38A and 38B, and bypass duct 42. FIG. 3 additionally shows fuel injector 18, opening 60, mounting element 62, nozzle opening 68, passages 70 and 72, threaded fitting 74, fuel inlet 76, seals 78, and fluid flow F. FIG. 3 provides a more detailed view of inlet scoop 36B configured to delivery high-pressure air and fuel to combustion chamber 26 and assembly with fuel injector 18.

As illustrated in FIG. 3, inlet scoop 36B extends axially from upstream end 64 to downstream end 66. Inlet scoop 36B is open at upstream end 64 to receive fluid flow F (high-pressure air) from an outlet of the compressor section of the gas turbine engine. In some embodiments, upstream edges of side walls 54 can be angled downstream from outermost wall 56 toward a radially innermost extent of inlet scoop 36B. Side walls 54 and outermost wall 56 can converge at downstream end 56 to direct fluid flow F into holes 44 and chutes 34A. Side walls 54 and outermost wall 56 can be shaped to increase a velocity of fluid flow F and efficiently direct fluid flow F into hole 44, while also promoting efficient fluid flow about inlet scoop 36B and aft thereof (e.g., reducing wake formation and recirculation). For example, in some embodiments, downstream end 66 can be defined in part by a convexly curved outermost wall 56 and trailing edge defined at a joint of side walls 54. In some embodiments, flow guides 32 and/or chutes 34A can have a geometry at an aft end substantially matching a geometry of downstream end 66 of inlet scoops 36. For example, in some examples, chutes 34A and flow guides 32 can have a teardrop or partial teardrop shape, respectively.

Splash plate 58 connects inner surfaces of opposing side walls 54 of inlet scoop 36B. Splash plate 58 can extend axially between side walls 54 to divide fluid flow F into radially outermost flow path F1 and radially innermost flow path F2 from upstream end 64 toward hole 44. Splash plate 58 can extend from a location adjacent to an edge of side walls 54 at upstream end 64. A downstream end of splash plate 58 can curve radially inward toward hole 44 to maintain separation between radially outermost flow path F1 and radially innermost flow path F2 as the fluid enters hole 44. The curvature of the downstream end of splash plate 58 can generally follow a curvature of downstream end 66 of inlet scoop 36B (e.g., a curvature of outermost wall 56). As illustrated in FIG. 3, a height between splash plate 58 and outermost wall 56 can decrease axially from upstream end 64 toward downstream end 66 as illustrated by height H1 at a location adjacent to upstream end 64 and height H2 at a downstream location, which is less than height H1. The reduction in height can increase the velocity of fluid flow through radially outer flow path F1 to improve atomization of fuel ejected from fuel injector 18 into outer radial flow path F1.

Strut 38B connects outermost wall 56 of inlet scoop 36B to radially inner surface 52 of outer case 14. In some examples strut 38B can extend from upstream end 64 of inlet scoop 36B to a location adjacent to downstream end 66. A downstream edge of strut 38B can be angled in a downstream direction from outermost wall 56 toward radially inner surface 52. As previously discussed, struts 38 are not limited to the embodiments shown. Generally, struts 38, including strut 38B, can have a shape suitable for supporting inlet scoops 36 in duct 28 and, preferably, are shaped to minimize or limit disruption of fluid flow F through duct 28. Strut 38B can further be configured to support fuel injector 18. For example, in some embodiments, strut 38B can include passage 70 configured to receive fuel injector 18. Passage 70 can extend to opening 60 in outermost wall 56 of inlet scoop 36B.

Fuel injector 18 can be received through mounting element 63 provided in outer case 14. Mounting element 63 can include passage 72, aligned with passage 70 of strut 38B, and threaded fitting 74 disposed at a radially outer end of passage 72. Fuel injector 18 can extend through a passages 70 and 72 and through opening 60 into inlet scoop 36B. Fuel injector 18 can include inlet 76 disposed in fluid communication with fuel manifold 40 (shown in FIGS. 1, 2, and 4). Seals 78 can be disposed on either side of inlet 76 to prevent leakage of fuel through passage 72. Nozzle outlet 68 is disposed in radially outer flow path F1 of inlet scoop 36B. Nozzle outlet 68 can be oriented to face splash plate 58 in a region of curvature adjacent to the downstream end of splash plate 58. In assembly, fuel injector 18 can be inserted into passages 70 and 72 and fixedly mounted to outer case 14 via threaded fitting 74.

Figure 4:
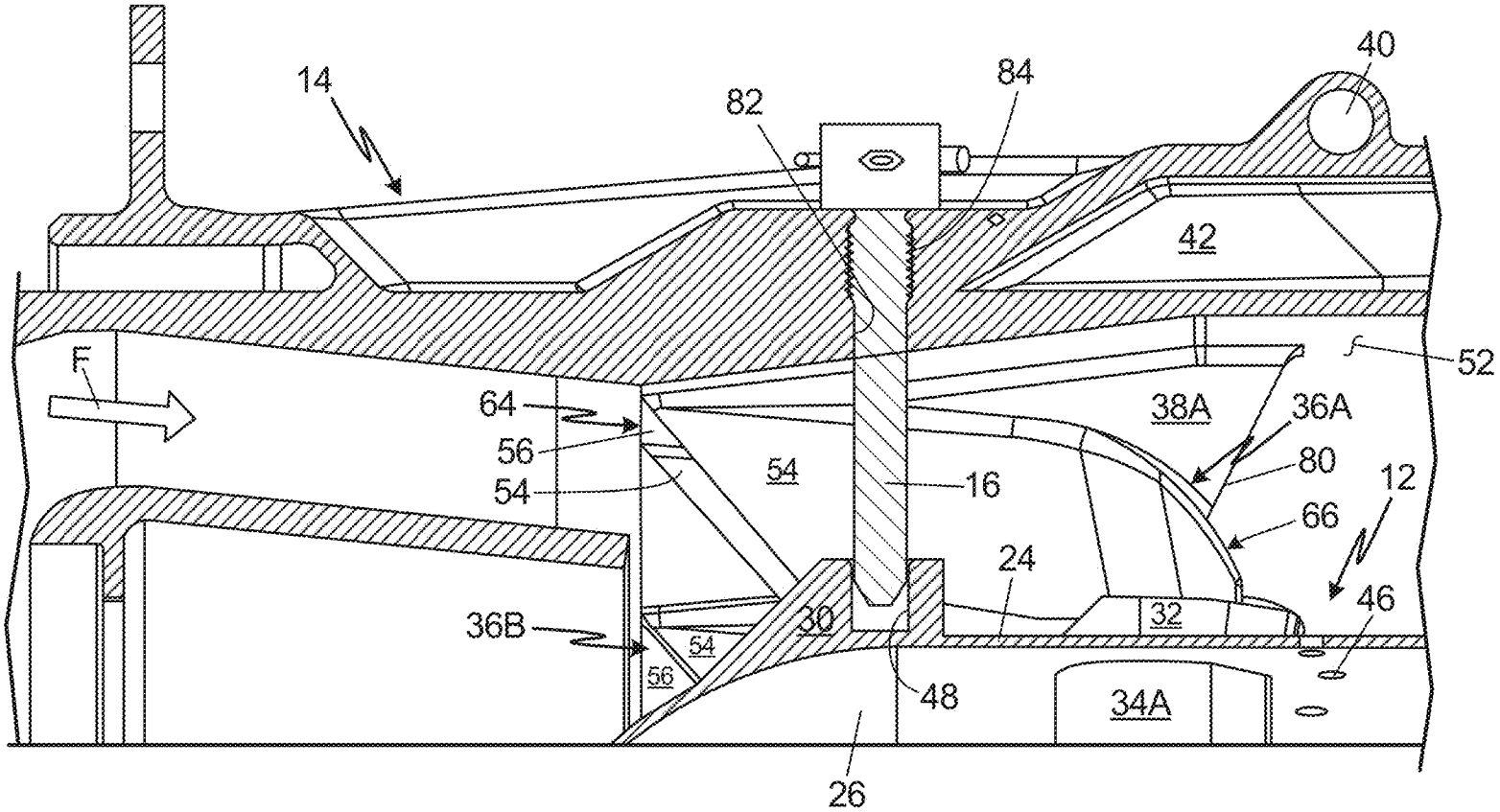
FIG. 4 is a cross-sectional view of the combustor assembly taken along the 4-4 line of FIG. 1.

FIG. 4 is a cross-sectional view of combustor assembly 10 taken along the 4-4 line of FIG. 1. FIG. 4 shows combustor liner 12, including outer wall 24, combustion chamber 26, mounting boss 30, flow guide 32, chute 34A, cooling holes 46, and retention hole 48; and outer case 14, including inlet scoops 36A and 36B with side walls 54, outermost wall 56, upstream end 64, and downstream end 66, strut 38A, fuel manifold 40, downstream edge 80, bypass duct 42, passage 82, and threaded fitting 84. FIG. 4 additionally shows locating pin 16 and fluid flow F. FIG. 4 provides a more detailed view of the assembly of combustor liner 12 with outer case 14 via locating pin 16 and a shape of strut 38A, which can be substantially similar to strut 38B of FIG. 3, shown in cross-section.

As previously described, inlet scoop 36A can be substantially similar to inlet scoop 36B except for splash plate 58, which is provided only in inlet scoops 36B to promote atomization of fuel from fuel injectors 18. As previously described with respect to inlet scoop 36B, inlet scoop 36A extends axially from upstream end 64 to downstream end 66. Inlet scoop 36A is open at upstream end 64 to receive fluid flow F (high-pressure air) from an outlet of the compressor section of the gas turbine engine. In some embodiments, upstream, edges of side walls 54 can be angled downstream from outermost wall 56 toward a radially innermost extent of inlet scoop 36A. Side walls 54 and outermost wall 56 can converge at downstream end 56 to direct fluid flow F into holes 44 and chutes 34A. Side walls 54 and outermost wall 56 can be shaped to increase velocity of fluid flow F and effectively direct fluid flow F into hole 44, while also promoting efficient fluid flow about inlet scoop 36B and aft thereof (e.g., reducing wake formation and recirculation).

Strut 38A can extend radially outward from outermost surface 56 of inlet scoop 36A to radially inner surface 52 of outer case 14 with increasing height measured therebetween from upstream end 64 to downstream end 66. Strut 38A can extend in attachment to inlet scoop 36A from a location adjacent to upstream end 64 to a location adjacent to downstream end 66. Strut 38A can be spaced from an aftmost end of downstream end 66 in attachment and may include a downstream edge 80 that slopes in a downstream direction from outermost wall 56 to radially inner surface 52. As previously discussed, strut 38B, shown in FIG. 3, can be substantially similar to strut 38A but may include a thickened region or additional structure to support fuel nozzle 18. Generally, struts 38 can be configured to provide structural support to inlet scoops 36 while minimizing or limiting blockage of fluid flow F between outermost wall 56 and radially inner wall 52 and, preferably, promoting efficient fluid flow F through duct 28.

Mounting boss 30 extends radially outward from outer wall 24 toward outer case 14 and is configured to receive locating pin 16 in assembly of combustor liner 12 with outer case 14. As previously described, at least three mounting bosses 30 and locating pins 16 are provided about combustor liner 12. A location of mounting bosses 30 can be selected to provide a desired support of combustor liner 12 and for ease of assembly with outer case 14. Preferably, mounting bosses 30 and locating pins 16 extending therefrom are positioned and configured to minimize or limit blockage of fluid flow F through duct 28 and to prevent blockage of fluid flow F into inlet scoops 36. In some embodiments, mounting bosses 30 can be disposed at a location adjacent to a forward end of combustor liner 12. Mounting bosses 30 located adjacent the primary combustion zone are preferably disposed between adjacent inlet scoops 36. In some embodiments, mounting bosses 30 can be disposed between adjacent inlet scoops 36 upstream of flow guides 32. Mounting bosses 30 can have an aerodynamic shape to promote efficient fluid flow about and downstream of mounting bosses 30.

Mounting bosses 30 include retention holes 48 configured to slidingly receive locating pins 16. Retention holes 48 can have a diameter slightly greater than an outer diameter of locating pins 16 and a radial depth greater than a radial extent of locating pins 16 upon assembly to allow combustor liner 12 to moved radially about locating pins 16 with thermal expansion during operation of the gas turbine engine.

Locating pins 16 can be received in passage 82 of outer case 14 and inserted into retention holes 48. Locating pins 16 are fixed to outer case 14. For example, in some embodiments, locating pins 16 can be threadedly fastened to threaded fitting 84 in passage 82. In other embodiments, locating pins 16 can be fastened via a mounting boss on an outer surface of outer case 14. Locating pins 16 can be removably fixed to outer case 14 by any suitable means know in the art. Locating pins 16 can have any configuration suitable for assembly with combustor liner 12 as described herein and attachment to outer case 14.

In assembly, combustor liner 12 can be positioned within outer case 14 such that retention holes 48 align with passages 82 in outer case 14 configured to receive locating pins 16. Locating pins 16 can be inserted through outer case 14 and into retention holes 48. Locating pins 16 can be fixed to outer case 14 via threaded fastener or similar fastener suitable for retaining a radial extent of locating pins 16 into retention holes 48 and preventing locating pins 16 from inadvertent disengagement from retention holes 48 during operation. Together, locating pins 16 and mounting bosses 30 constrain rotation, axial displacement, and radial displacement of combustor liner 12 within outer case 14.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

A combustor assembly for a gas turbine engine includes a combustor liner disposed about an axis and defining a combustion chamber and an outer case disposed about the combustor liner and defining an air flow duct therebetween. The combustor liner includes an outer wall having a plurality of mounting bosses and a plurality of first holes open to the combustion chamber. The outer case includes a plurality of inlet scoops extending radially inward of the outer case and radially aligned with the plurality of first holes to guide an air flow into first holes. A plurality of pins is fixed to the outer case and slidingly received in openings in the plurality of mounting bosses.

The combustor assembly of the preceding paragraph can optionally include, additionally and/or alternatively, any one or more of the following features, configurations, and/or additional components:

In an embodiment of preceding combustor assembly, the plurality inlet scoops can extend axially from an open first end to a closed second end opposite the first end and can have converging walls.

In an embodiment of any of the preceding combustor assemblies, each of the plurality of inlet scoops can be attached to the outer case by a strut.

In an embodiment of any of the preceding combustor assemblies, the plurality of inlet scoops can be spaced radially from the outer wall of the combustor liner.

In an embodiment of any of the preceding combustor assemblies, each of the plurality of inlet scoops can include a radially outer wall connecting two side walls with the radially outer wall spaced radially from the outer case.

In an embodiment of any of the preceding combustor assemblies, a subset of the plurality of inlet scoops can include a splash plate. The splash plate can be spaced radially inward from the radially outer wall and connecting the two side walls.

In an embodiment of any of the preceding combustor assemblies, a height measured between the splash plate and the radially outer wall can decrease from the open first end toward the closed second end.

In an embodiment of any of the preceding combustor assemblies, the outer case can further include a plurality of fuel injectors. Each of the plurality of fuel injectors can extend through a strut of the subset of the plurality of inlet scoops and can include a nozzle opening oriented to face the splash plate.

In an embodiment of any of the preceding combustor assemblies, the outer case can further include an integral fuel manifold fluidly connected to the plurality of fuel injectors.

In an embodiment of any of the preceding combustor assemblies, the two side walls can angle inward from the radially outer wall toward the outer wall of combustor liner.

In an embodiment of any of the preceding combustor assemblies, the combustor liner can further include a plurality of flow guides extending radially outward from the combustor liner. The plurality of flow guides can partially surround the plurality of first holes and a portion of each of the plurality of inlet scoops can be configured to be received in a respective flow guide.

In an embodiment of any of the preceding combustor assemblies, the combustor liner can further include a plurality of chutes projecting from the plurality of first holes into the combustion chamber.

In an embodiment of any of the preceding combustor assemblies, the combustor liner can further include a plurality of second holes. The plurality of first holes can be arranged circumferentially in a first row and the plurality of second holes can be arranged circumferentially in a second row aft of the plurality of first holes with respect to a direction of the air flow through the combustor assembly.

In an embodiment of any of the preceding combustor assemblies, the outer case can further include a bypass duct disposed radially outward of the air flow duct.

A combustor assembly for a gas turbine engine includes a combustor liner disposed about an axis and defining a combustion chamber and an outer case disposed about the combustor liner and defining an air flow duct therebetween. The combustor liner includes an outer wall having a plurality of mounting bosses, a plurality of holes open to the combustion chamber, and a plurality of flow guides extending radially outward from the outer wall partially around the plurality of holes. The outer case includes a plurality of inlet scoops connected to and extending radially inward of the outer case the plurality of holes. The plurality of inlet scoops extend axially from an open first end to a closed second end opposite the first end. The plurality of inlet scoops include walls that converge in extension from the first end to the second end. A plurality of pins is fixed to the outer case and slidingly received in openings in the plurality of mounting bosses.

The combustor assembly of the preceding paragraph can optionally include, additionally and/or alternatively, any one or more of the following features, configurations, and/or additional components:

In an embodiment of the preceding combustor assembly, each of the plurality of inlet scoops can be attached to the outer case by a strut.

In an embodiment of the preceding combustor assemblies, each of the plurality of inlet scoops can include a radially outer wall and two side walls and a subset of the plurality of inlet scoops can include a splash plate spaced radially inward from the radially outer wall and connecting the two side walls.

In an embodiment of the preceding combustor assemblies, the outer case can further include a fuel manifold integrally formed therewith and a plurality of fuel injectors. The plurality of fuel injectors can extend through the strut and radially outer wall of the subset of the plurality of inlet scoops.

In an embodiment of the preceding combustor assemblies, the plurality of flow guides can be sized to receive a portion of the plurality of inlet scoops such that the plurality of flow guides and the portions of the plurality of inlet scoops overlap radially.

In an embodiment of the preceding combustor assemblies, the combustor liner can further include a plurality of chutes projecting from the plurality of holes into the combustion chamber.

The invention claimed is:

1. A combustor assembly for a gas turbine engine, the combustor assembly comprising:

a combustor liner disposed about an axis and defining a combustion chamber, the combustor liner comprising:

an outer wall comprising a plurality of mounting bosses; and a plurality of first holes open to the combustion chamber;

an outer case disposed about the combustor liner and defining an air flow duct therebetween, the outer case comprising:

a plurality of inlet scoops extending radially inward of the outer case, the plurality of inlet scoops radially aligned with the plurality of first holes and configured to guide an air flow into the plurality of first holes;

wherein the plurality inlet scoops extend axially from an open first end to a closed second end, the second end opposite the first end, and comprise converging walls;

wherein each of the plurality of inlet scoops is attached to the outer case by a strut;

wherein each of the plurality of inlet scoops comprises a radially outer wall connecting two side walls, wherein the radially outer wall is spaced radially from the outer case wherein the plurality of inlet scoops is spaced radially from the outer wall of the combustor liner; and wherein a subset of the plurality of inlet scoops comprises a splash plate, the splash plate spaced radially inward from the radially outer wall and connecting the two side walls, wherein a height measured between the splash plate and the radially outer wall decreases from the open first end toward the closed second end; and a plurality of pins fixed to the outer case and slidingly received in openings in the plurality of mounting bosses.

2. The combustor assembly of claim 1, wherein the outer case further comprises a plurality of fuel injectors, wherein each of the plurality of fuel injectors extends through the strut of the subset of the plurality of inlet scoops and comprises a nozzle opening oriented to face the splash plate.

3. The combustor assembly of claim 2, wherein the outer case further comprises an integral fuel manifold fluidly connected to the plurality of fuel injectors.

4. The combustor assembly of claim 1, wherein the two side walls angle inward from the radially outer wall toward the outer wall of the combustor liner.

5. The combustor assembly of claim 1, wherein the combustor liner further comprises a plurality of flow guides extending radially outward from the combustor liner, wherein the plurality of flow guides partially surrounds the plurality of first holes and wherein a portion of each of the plurality of inlet scoops is configured to be received in a respective flow guide.

6. The combustor assembly of claim 5, wherein the combustor liner further comprises a plurality of chutes projecting from the plurality of first holes into the combustion chamber.

7. The combustor assembly of 1, wherein the combustor liner further comprises a plurality of second holes, wherein the plurality of first holes is arranged circumferentially in a first row and the plurality of second holes is arranged circumferentially in a second row aft of the plurality of first holes with respect to a direction of the air flow through the combustor assembly.

8. The combustor assembly of claim 1, wherein the outer case further comprises a bypass duct disposed radially outward of the air flow duct.

9. A combustor assembly for a gas turbine engine, the combustor assembly comprising:

a combustor liner disposed about an axis and defining a combustion chamber, the combustor liner comprising:

an outer wall comprising a plurality of mounting bosses;

a plurality of holes open to the combustion chamber; and a plurality of flow guides extending radially outward from the outer wall partially around the plurality of holes;

an outer case disposed about the combustor liner and defining an air flow duct therebetween, the outer case comprising a plurality of inlet scoops connected to and extending radially inward of the outer case and radially aligned with the plurality of holes, the plurality of inlet scoops extending axially from an open first end to a closed second end, the second end opposite the first end, and comprising walls that converge in extension from the first end to the second end; and a plurality of pins fixed to the outer case and slidingly received in openings in the plurality of mounting bosses.

10. The combustor assembly of claim 9, wherein each of the plurality of inlet scoops is attached to the outer case by a strut.

11. The combustor assembly of claim 10, wherein each of the plurality of inlet scoops comprises a radially outer wall and two side walls and wherein a subset of the plurality of inlet scoops comprises a splash plate, the splash plate spaced radially inward from the radially outer wall and connecting the two side walls.

12. The combustor assembly of claim 11, wherein the outer case further comprises a fuel manifold integrally formed therewith and a plurality of fuel injectors, the plurality of fuel injectors extending through the strut and radially outer wall of the subset of the plurality of inlet scoops.

13. The combustor assembly of claim 9, wherein the plurality of flow guides are sized to receive a portion of the plurality of inlet scoops such that the plurality of flow guides and the portions of the plurality of inlet scoops overlap radially.

14. The combustor assembly of claim 9, wherein the combustor liner further comprises a plurality of chutes projecting from the plurality of holes into the combustion chamber.

* * * * *